United States Patent [19]

Mailander

[11] 4,421,963

[45] Dec. 20, 1983

[54] MAGNETIC EXTINCTION OF ARCS IN SWITCHES

[75] Inventor: Martin Mailander, Leinfelden, Fed. Rep. of Germany

[73] Assignee: Deutsche Forschungs- und Vesuchsanstalt für Luft und Raumfahrt e.V., Fed. Rep. of Germany

[21] Appl. No.: 276,174

[22] Filed: Jun. 22, 1981

[30] Foreign Application Priority Data

Jun. 25, 1980 [DE] Fed. Rep. of Germany ..... 3023673

[51] Int. Cl.[3] ..... H01H 9/44; H01H 33/18

[52] U.S. Cl. ..... 200/147 R; 200/147 A

[58] Field of Search ..... 200/144 R, 144 A, 144 B, 200/147 R, 147 A, 147; 335/201

[56] References Cited

U.S. PATENT DOCUMENTS

| | | | |
|---|---|---|---|
| 577,371 | 2/1897 | Patten | 200/147 A |
| 3,376,401 | 4/1968 | Bazi et al. | 200/147 A |
| 3,953,694 | 4/1976 | Bernard et al. | 200/147 A |
| 4,160,140 | 7/1979 | Rolff | 200/147 A |
| 4,250,364 | 2/1981 | Kimblin et al. | 200/144 B |

FOREIGN PATENT DOCUMENTS

| | | | |
|---|---|---|---|
| 893825 | 10/1953 | Fed. Rep. of Germany . | |
| 1183986 | 12/1964 | Fed. Rep. of Germany . | |
| 626271 | 7/1949 | United Kingdom | 200/147 R |
| 853162 | 11/1960 | United Kingdom | 200/147 R |

OTHER PUBLICATIONS

C. J. Gallagher, Journal of Applied Physics, "The Retrograde Motion of the Arc Cathode Spot", Aug. 1950, vol. 21, pp. 768–771.

V. I. Alferov et al., Sov. Phys. Tech. Phys., "Retrograde Motion of the Current in a Discharge in a Transverse Magnetic Field", vol. 22, No. 1, Jan. 1977, pp. 57–62.

Eidinger et al., "Verhalten des Lichtbogens im transversalen Magnetfeld" Archiv für Electrotechnik, vol. 43, Section 2, 1957, pp. 94–114.

*Primary Examiner*—J. R. Scott

*Attorney, Agent, or Firm*—Kenway & Jenney

[57] ABSTRACT

The arc formed during circuit-breaking is lengthened to extinction. In order to achieve this, the magnetic flux density, the arc current intensity, and the gas pressure, adjacent the cathodic spot 11, are chosen to be such that the cathodic spot 11 is displaced contrary to the Lorentz force. The necessary magnetic field is preferably provided by a magnet 6 whose stray magnetic field has flux lines which form an arched tunnel extending along the cathode 1.

16 Claims, 4 Drawing Figures

MAGNETIC EXTINCTION OF ARCS IN SWITCHES

BACKGROUND OF THE INVENTION

The invention relates to a method of extinguishing the unwanted arc formed in a switch during circuit-breaking, using a magnetic field by means of which the arc is lengthened until it is extinguished.

When opening an electric switch, a problem is encountered in that an electric arc forms on separation of the switch contacts, prevents interruption of the circuit, and causes destruction of the switch contacts. Attempts have therefore been made, using various aids, to prevent the formation of such an arc or at least to allow rapid extinction of the arc.

It is known for this purpose to introduce extinguishing gases into the switch housing, but this has the disadvantage that the structural design of such a switch is very complicated since the switch chamber must be sealed gas-tight from the environment.

Another method of extinguishing the arc involves generating a magnetic field in the region of the switch contacts. The arc normally moves in this magnetic field under the influence of the Lorentz force. If the switch contacts are formed in such a way that the distance between the contacts increases in the direction of movement of the arc under the influence of the Lorentz force by using, for example, switch contacts which are curved away from each other, then the electrical arc will become progressively longer during the displacement under the influence of the magnetic forces until it finally breaks. This operation is called magnetic blow-out. Although this method operates well in itself, it takes a relatively long time for the electric arc to achieve the length needed to break, i.e. the extinction of the arc does not take place quickly enough in many cases.

SUMMARY OF THE INVENTION

The present invention provides a method of extinguishing the arc formed between the contacts of a circuit-breaking switch using a magnetic field by means of which the arc is lengthened until it breaks, in which the cathodic spot is displaced against the direction of the Lorentz force.

Displacement of the cathodic spot contrary to the Lorentz displacement can be achieved by selecting the magnetic field B, the current intensity i of the arc, and the pressure at the cathodic spot in such a way that the following inequality applies:

$$X > Y \tag{1}$$

wherein the following definitions apply:

$$X = a\frac{B}{p_F + p_K} \tag{2}$$

$$Y = \frac{\gamma}{a} i(p_F + p_K) \tag{3}$$

where a and $p_K$ are material constants of the cathode material and $\gamma$ is a constant of the switch geometry, whereas $p_F$ indicates the gas pressure in the region adjacent to the cathode.

It is known that, under certain conditions, the cathodic spot of an electric arc is deflected by a magnetic field not in the direction of the Lorentz force but in the opposite direction. This effect is exploited according to the invention to accelerate the extinction of the arc. This reversed movement of the electric arc in the cathodic spot, which will hereinafter be called retrograde motion, can be obtained when the above-mentioned conditions are observed and, with a given switch arrangement and when using a certain material, these can be adjusted by suitable selection of the magnetic flux density B (beta), the arc current intensity i, and the pressure in the region of the cathodic spot.

With suitable selection of these values, the cathodic spot of the arc is displaced against the Lorentz force whereas the remainder of the arc, in particular the anodic spot, is displaced in the direction of the Lorentz force under the influence of the magnetic field. In other words, the anodic spot and cathodic spot of the electric arc do not both travel in the same direction (as with pure Lorentz displacement) but in opposite directions. This causes the arc to lengthen extremely rapidly, and very rapid breaking of the arc and therefore very rapid extinction of the arc are obtained.

It is advantageous if an external magnetic field is generated in the cathodic region of the arc.

In order to generate retrograde motion at the moment of circuit-breaking, it is possible for the external magnetic field to be increased during circuit-breaking and/or for the pressure $p_F$ to be reduced during circuit-breaking.

In a magnetic field arrangement with which the above-described method for extinguishing the arc can be carried out in an advantageous manner, the magnetic field lines on the side of the cathode facing the opposing electrode are arranged in the form of an arch, at least over a region of the cathode length, and form a magnetic tunnel.

Such an arrangement has proven to be particularly advantageous since the cathodic spot moves within this magnetic tunnel during the retrograde motion, and the path of travel of the cathodic spot can thus be influenced by a suitable configuration of the magnetic tunnel.

In this arrangement it is advantageous if the cathode is arranged in the region of the stray field of a magnet which forms the magnetic tunnel.

BRIEF DESCRIPTION OF THE DRAWINGS

The invention will be described further, by way of example, with reference to the accompanying drawings, in which.

DESCRIPTION OF THE PREFERRED EMBODIMENT

The switch illustrated has as one contact a flat stationary metal plate which will be designated the cathode 1. Facing it, there is an opposing contact, designated the anode 2, which is curved in the longitudinal drection and is mounted so as to be movable perpendicularly to the cathode 1. The cathode 1 and anode 2 are connected into an electrical circuit by means of wires 3 and 4 respectively.

Figure 4:
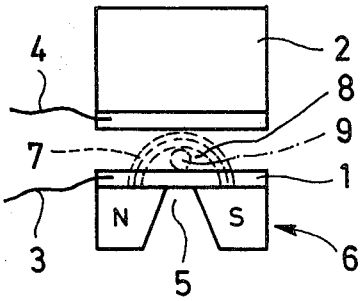
FIG. 4 is an end view of the switch in the direction of the arrow A in FIG. 2.

The cathode 1 lies over an air gap 5, extending parallel to the cathode 1, of a permanent magnet 6, the width of the gap being reduced towards the cathode 1 (FIG. 4). The magnetic flux lines 7 connecting the poles of the magnet 6 pass through the cathode 1 and, owing to their arched shape, form a magnetic tunnel 8 extending along the cathode 1 above the surface thereof.

Figure 1:
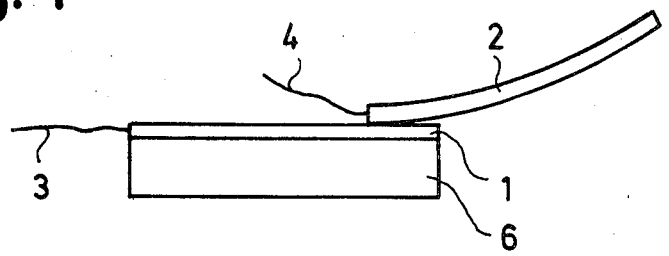
FIG. 1 is a side view of a switch in the closed position.

In the closed state of the switch, the cathode 1 and the anode 2 are adjacent to each other, as shown in FIG. 1. As the switch is opened, the anode 2 is separated from the cathode 1. In this process there is formed between the original contact positions an electric arc 9 (FIG. 2) whose anodic spot 10 is displaced in the direction of the arrow D, towards the remote end of the anode 2 either under the influence of the magnetic field generated by the arc itself or under the influence of an external magnetic field running perpendicularly to the plane in the drawing. This displacement takes place owing to the Lorentz force which is both perpendicular to the magnetic flux lines and perpendicular to the arc current.

Figure 2:
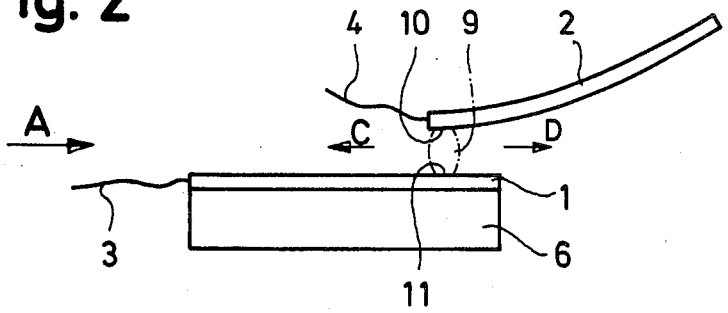
FIG. 2 is a side view of the switch just after opening the switch.
Figure 3:
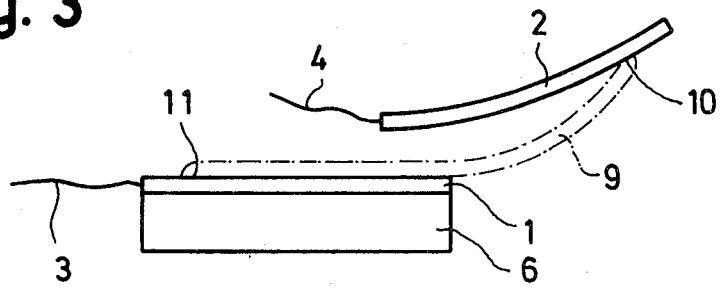
FIG. 3 is a side view similar to FIG. 2 but at a later time, with an electric arc lengthened by retrograde motion.

Owing to a specific selection (explained below) of the magnetic field generated by the magnet 6, the current 1 in the electric arc, and the pressure at the cathodic spot 11, the cathodic spot 11 travels in the opposite direction, i.e. in the direction of the arrow C in Fig. 2. This retrograde motion opposed to the Lorentz movement removes the cathodic spot 11 from its initial position opposite the anodic spot 10, the cathodic spot 11 travelling inside the magnetic tunnel 8. The arc is thus stretched extremely greatly since the movement of the anodic spot 10 and the movement of the cathodic spot 11 are in opposite directions. The arc therefore receives the configuration shown in FIG. 3, initially travelling along the cathode surface in the magnetic tunnel 8 and curving up from the end of the cathode 1 towards the anodic spot 10.

It is obvious that, owing to the opposing movement of the two arc spots, accelerated lengthening thereof and therefore faster breaking of the electric arc are obtained.

In order to obtain the desired retrograde motion (instead of the Lorentz displacement of the electric arc usually obtained at the cathodic spot), the magnetic flux density B at the cathodic spot, the pressure $p_F$ in the region of the cathodic spot, and the current intensity i of the electric arc are appropriately selected. If the inequality $$a\frac{B}{p_F + p_K} > \frac{\gamma}{a} \cdot i(p_F + p_K)$$

applies, then the cathodic spot travels in the opposite direction to the Lorentz force and retrograde motion is thus obtained.

As mentioned above, a and $p_K$ are material constants of the cathode material; $\gamma$ is essentially a constant of the switch geometry adopted and includes, among other things, the distance between electrodes as well as the flow resistance of the arc in the gas.

Values of the material constants a and $p_K$ for various cathode materials are given in Tables 1 and 2 below.

TABLE 1

$a\left[10^5 \frac{\text{Pa m}}{\text{T s}}\right]$ where Pa = Pascal, M = Meter, T = Tesla and S = Second

| Metal | Material Constant (a) |
|---|---|
| Hg | 5.51 |
| Zn | 117 |
| Pb | 38.5 |
| Al | 706 |
| Sn | 181 |
| Ni | 416 |
| Ti | 415 |
| Mo | 445 |

TABLE 2

$p_K$ [$10^5$ Pa] where Pa = Pascal

| Metal | Material Constant ($p_K$) |
|---|---|
| Hg | 0.041 |
| Zn | 2.03 |
| Pb | 0.445 |
| Al | 3.81 |
| Sn | 1.10 |
| Ni | 1.95 |
| Ti | 2.34 |
| Mo | 1.61 |

With a given switch arrangement with given cathode material, it is therefore sufficient either to select the magnetic flux density B sufficiently large and/or the arc current intensity i and/or the pressure $p_F$ sufficiently small in order to obtain the effect of retrograde motion. It is particularly advantageous in this arrangement if the magnetic field is temporarily increased and/or the pressure in the cathode region is temporarily reduced at the moment of opening the switch. In order to keep the arc current low, it is possible to divide the cathode into a number of parallel cathodes, i.e. to generate a number of arcs burning next to each other, in which case the current in each arc is correspondingly low.

An extremely effective method of accelerating the extinction of an arc is thus obtained by selecting suitable values B, i, and $p_F$ and by means of an extremely simple design of the switch. The method can also be carried out without further ado in switches of a conventional design if sufficient room is available on the cathode for the retrograde displacement of the cathodic spot from the point at which the switch contacts touch.

I claim:

1. A method of extinguishing the arc formed between an anodic spot and a cathodic spot on the respective contacts of a circuit-breaking switch, comprising causing the cathodic spot to be displaced along the surface of said contact with said cathodic spot under the influence of a magnetic field in a direction contrary to the direction of the Lorentz force so that the arc is lengthened until it is extinguished.

2. A method as claimed in claim 1, in which the magnetic flux density B, the arc current intensity i, and the gas pressure $p_F$, adjacent the cathodic spot, are such that the following inequality applies:

$$a\frac{B}{p_F + p_K} > \frac{\gamma}{a} \cdot i(p_F + p_K),$$

where a and $p_K$ are material constants of the cathode material and $\gamma$ is a constant of the switch geometry.

3. A method as claimed in claim 1, including generating an external magnetic field in the region of the cathode spot.

4. A method as claimed in claim 3, including increasing the flux density of the external magnetic field during circuit-breaking.

5. A method as claimed in claim 3, in which the flux lines of the magnetic field from an arched tunnel extending over the cathode spot and along the cathode.

6. A method as claimed in claim 1, including decreasing the gas pressure in the region of the cathode spot during circuit-breaking.

7. A switch for circuit-breaking, comprising two contacts which constitute an anode and a cathode during circuit-breaking when an arc is formed between an anodic spot and a cathodic spot on the respective contacts, and means for generating a magnetic field in the region of the cathode such that the cathodic spot is displaced under the influence of said magnetic field along the surface of said cathodic contact contrary to the direction of the Lorentz force, whereby the arc is lengthened until it is extinguished.

8. A switch as claimed in claim 7, in which the flux lines of the magnetic field form an arched tunnel extending along the cathode.

9. A switch as claimed in claim 7 or 8, in which the magnetic field generating means comprises a magnet providing a stray field in which the cathode is located.

10. A method of extinguishing the arc formed between an anodic spot and a cathodic spot on the respective contacts of a circuit-breaking switch comprising:

generating an external magnetic field in the region of the cathodic spot;

increasing the flux density of the external magnetic field during circuit-breaking;

forming a magnetic tunnel from the magnetic flux density of said external magnetic field in the area of the cathodic switch contact along a surface section of said cathodic switch contact facing the anodic switch contact, the flux lines of said external magnetic field emerging from said surface section of said cathodic switch contact, extending in the form of an arch above said cathodic switch contact and re-entering said surface section of said cathodic switch contact at another point;

causing the cathodic spot to be displaced through said magnetic tunnel in a direction which is contrary to the direction of the Lorentz force so that the arc is lengthened until it is extinguished.

11. A method is claimed in claim 10 in which the magnetic flux density B, the arc current intensity i, and the gas pressure $p_F$, adjacent to cathodic spot, are such that the following inequality applies:

$$a\frac{B}{p_F + p_K} > \frac{\gamma}{a} \cdot i(p_F + p_K),$$

where a and $p_K$ are material constants of the material of the cathodic switch contact and $\gamma$ is a constant of the switch geometry used whereas $p_F$ indicates the gas pressure in the region adjacent to the cathode.

12. A method as claimed in claim 10, including decreasing gas pressure in the region of the cathode spot during circuit-breaking.

13. A switch for circuit-breaking comprising:

two switch contacts which constitute an anode and a cathode during circuit-breaking when an arc is formed between an anodic spot and a cathodic spot on the respective contacts, said switch contacts resting against each other when the switch is closed and separated from each other when the switch is opened, said cathode being of a flat design;

means for generating an external magnetic field in the region of the cathode;

a magnetic tunnel formed by the magnetic flux density of said external magnetic field in the area of the cathodic switch contact along a surface section of said cathodic switch contact facing the anodic switch contact, the flux lines of said external magnetic field emerging from said surface section of said cathodic switch contact, extending in the form of an arch above said cathodic switch contact and re-entering said surface section of said cathodic switch contact at another point;

arc current intensity i and gas pressure pF of a magnitude sufficient to displace the cathodic spot of said arc in a direction contrary to the direction of the Lorentz force;

whereby the arc is lengthened until it is extinguished.

14. A switch as claimed in claim 13 in which the magnetic flux-density B, the arc current intensity i, and the gas pressure $p_F$, adjacent a cathodic spot, are such that the following inequality applies:

$$a\frac{B}{p_F + p_K} > \frac{\gamma}{a} \cdot i(p_F + p_K),$$

where a and $p_K$ are material constants of the material of the cathodic switch contact and $\gamma$ is a constant of the switch geometry used whereas $p_F$ indicates the gas pressure and the region adjacent to the cathode.

15. A switch as claimed in claim 13, in which the magnetic field generating means comprises a magnet providing a stray field in which the cathode is located.

16. A switch as claimed in claim 14, in which the magnetic field generating means comprises a magnet providing a stray field in which the cathode is located.

* * * * *